United States Patent [19]

Mathes et al.

[11] 4,157,652

[45] Jun. 12, 1979

[54] CONTINUOUS, RANDOM DYEING APPARATUS FOR CARPET OR THE LIKE

[76] Inventors: Donald R. Mathes, 9902 Dewey Dr., Garden Grove, Calif. 92641; Ramon M. Navarro, 19052 E. Center, Orange, Calif. 92669

[21] Appl. No.: 891,910

[22] Filed: Mar. 30, 1978

[51] Int. Cl.[2] ..... D06B 1/02; D06B 11/00

[52] U.S. Cl. ..... 68/22 B; 68/62; 68/205 R; 118/323; 118/406

[58] Field of Search ..... 68/22 B, 62, 200, 202, 68/203, 205 R; 118/DIG. 16, 323, 308–312, 325, 406, 414; 222/345, 349

[56] References Cited

U.S. PATENT DOCUMENTS

| | | | |
|---|---|---|---|
| 2,906,437 | 9/1959 | Wallis | 222/349 X |
| 3,401,542 | 9/1968 | Evans | 68/202 |
| 3,541,815 | 11/1970 | Appenzeller et al. | 68/62 X |
| 3,660,994 | 5/1972 | Gowin | 68/205 R |
| 3,800,569 | 4/1974 | Wilcox | 68/205 R |

FOREIGN PATENT DOCUMENTS

| | | | |
|---|---|---|---|
| 645837 | 9/1962 | Italy | 118/DIG. 16 |

*Primary Examiner*—Philip R. Coe
*Attorney, Agent, or Firm*—Philip M. Hinderstein

[57] ABSTRACT

Continuous, random dyeing apparatus for carpet or the like comprising a plurality of elongate drums mounted for rotation on parallel, spaced axes, each drum having a plurality of cavities extending partially thereinto from the outer surface thereof, wiper means engaging the outer surface on one side of each drum, along a line parallel to the axis thereof, means for rotating the drums in a direction such that the one sides thereof move downwardy, and means for conducting a dyeing liquid to the intersections between each drum and its associated wiper means. The liquid fills the cavities in the drums, on the one sides thereof, as the drums rotate and the liquid in the cavities passes below the wiper means and is dispensed below the drum onto a carpet moving therebelow.

19 Claims, 3 Drawing Figures

CONTINUOUS, RANDOM DYEING APPARATUS FOR CARPET OR THE LIKE

BACKGROUND OF THE INVENTION

1. Field of the Invention

The present invention relates to continuous, random dyeing apparatus for carpet or the like and, more particularly, to apparatus for continuously dispensing a liquid onto a moving web in an irregular and random pattern.

2. Description of the Prior Art

A recent trend in manufacturing tufted carpet involves finishing a single color carpet in such a way that although the single color remains the dominant base tone, additional color patterns are applied thereto. To be most effective, the color patterns should not appear in regularly recurring portions but should form a certain unified irregularity or randomness which is aesthetically pleasing to the eye. This type of coloring has further achieved significance in other fabrics, as for example decorative fabric materials. Accordingly, although the remaining discussion will be directed to carpets, it will be appreciated by those skilled in the art that it is equally applicable to any textile material and to moving webs generally.

A number of methods have been proposed for the continuous, random application of color to carpet. In order for any such method to be economically feasible, the application speed must be adequate and the application of the dye must be easily controlled in any number of various patterns. The methods of application and control must be relatively simple as well as being easy to maintain. However, none of the methods proposed heretofore have satisfied all of these requirements.

One method of producing a random pattern on carpet has been commonly designatd as "space dyeing". In this method, the yarn is dyed various colors and shades of colors along its length. This dyed yarn is then tufted into the carpet. The disadvantages of this method are that it is costly to space dye the yarn and, once the yarn is space dyed, there is only a limited control of the random pattern which is obtainable once the tufting of the carpet begins.

Another process, referred to as "Tak" dyeing, for applying dyes to carpet in random patterns is disclosed in U.S. Pat. No. 3,731,503. According to this patent, an oscillating wiper blade channels dye into streams which fall towards the moving carpet, which streams are divided by a moving wire member supported on a circular band. Some of the dye falls and is distributed on the teeth of an adjustable comb-like device, from which the dye falls to the carpet in an irregular pattern. The remaining dye falls directly onto the carpet after being divided by the circulating band. The problem with this process is that the machinery involved is complex in nature. This leads to difficulty in pattern control as well as a substantial expense to purchase and maintain the machinery.

Jet printing is another method of applying random patterns to carpet. According to this method, an array of spray nozzles, which spray different colors, are moved from place to place above a moving carpet. In addition, the nozzles are controlled as to whether they are open or closed. The patterns are programmed via an electronic device. The disadvantages associated with this method are that the equipment is expensive, the nozzles become clogged, and maintenance costs of the electronic and mechanical equipment is high.

A process referred to as rotary screen printing is also used to apply dye to carpet in a random pattern. In this process, a hollow rotary drum is used which has small holes etched through the surface thereof to the hollow portion, in any desired pattern. Dye is forced through these holes which are in contact with the carpet surface as the drum rotates. The main disadvantage here is that the resultant pattern is very rigid. In addition, the cost of the etched drums and the equipment needed to run them is expensive.

SUMMARY OF THE INVENTION

According to the present invention, these problems are solved by a novel method and apparatus for the continuous, random application of color to carpet or the like. The present method and apparatus produce a carpet which is aesthetically pleasing. The application speed is sufficient to make the present process economically feasible. In addition, the application of the dye can be easily controlled in any number of various patterns. The method of application control is relatively simple as well as being easy to maintain.

Briefly, the above objectives are achieved by using a rotating drum and a wiper engaging the outer surface thereof to control the flow and pattern of dye to a length of carpet. The drum is mounted for rotation on its axis and has a plurality of cavities extending partially thereinto, from the outer surface thereof. The cavities can have various depths, sizes, and patterns. This permits control of dye penetration and pattern size. The dye is conducted to one side of the drum where it fills the cavities. As the drum rotates, only the dye in the cavities passes below the wiper where such dye falls onto the moving carpet. The pattern is formed by adjusting the carpet feed speed in relation to the drum speed and the distance between the drum and the carpet. In this manner, the pattern is easily controlled and varied. By using a plurality of drums with cavities having different depths, sizes, and patterns, a truely random affect can be achieved. With such an apparatus, the speed of the carpet is relatively high due to the simplicity of mechanical synchronization. Because of the small number of moving parts, equipment and maintenance costs are relatively low.

It is therefore an object of the present invention to provide a continuous, random dyeing apparatus for carpet or the like.

It is a further object of the present invention to provide apparatus for continuously dispensing a liquid onto a moving web in an irregular and random pattern.

It is a still further object of the present invention to provide a continuous, random dyeing apparatus for carpet or the like which is economically feasible.

It is another object of the present invention to provide a continuous, random dyeing apparatus for carpet or the like in which a high degree of control over the random nature of the pattern is obtainable.

It is still another object of the present invention to provide a continuous, random dyeing apparatus for carpet or the like which is simple in structure, inexpensive, and easy to maintain.

Still other objects, features, and attendant advantages of the present invention will become apparent to those skilled in the art from a reading of the following detailed description of the preferred embodiment constructed in accordance therewith, taken in conjunction with the accompanying drawings wherein like numerals designate like parts in the several figures and wherein:

DESCRIPTION OF THE PREFERRED EMBODIMENT

Figure 1:
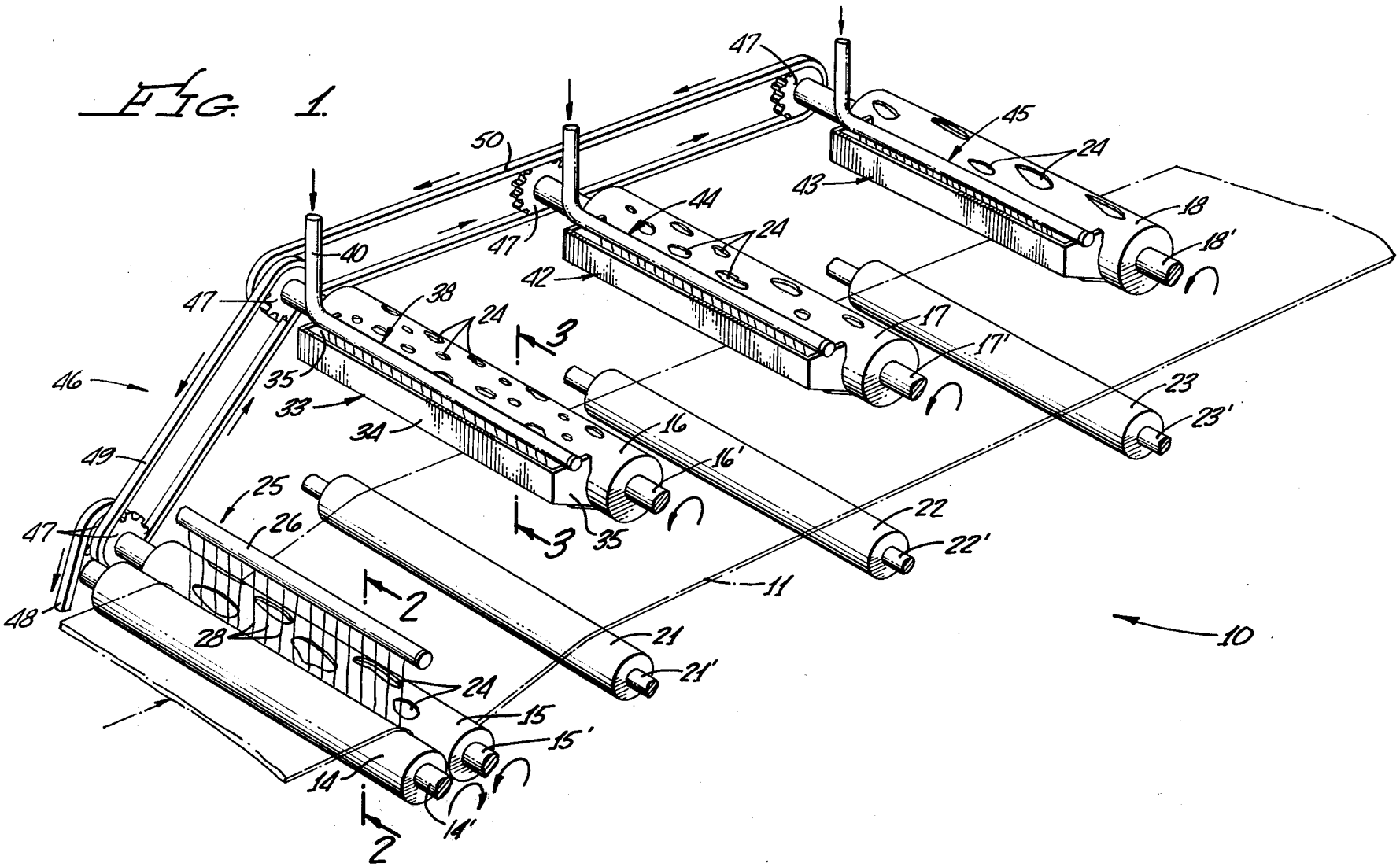
FIG. 1 is a perspective view, in highly simplified form, of a continuous, random dyeing apparatus for carpet or the like constructed in accordance with the present invention.

Referring now to the drawings, there is shown apparatus, generally designated 10, for the continuous, random dyeing of carpet or the like. Apparatus 10 is designed to apply dye, in liquid form, to a length of carpet 11 as carpet 11 moves through apparatus 10 in the direction of the arrows shown. As is known in the art, carpet 11 includes a backing 12 and pile 13.

Apparatus 10 includes a first pair of elongate rollers or drums 14 and 15 mounted for rotation on parallel, spaced-apart shafts 14' and 15', respectively, carpet 11 extending over drum 14, between drums 14 and 15, and under drum 15. After extending beneath drum 15, carpet 11 extends above elongate drums 21–23 which are mounted for rotation on parallel spaced-apart shafts 21'–≦', respectively, and operate to support carpet 11 as it passes through apparatus 10. Drums 14, 15, and 21–23 are approximately coplanar.

Positioned above the plane of drums 14, 15, and 21–23 are three more elongate rollers or drums 16–18 mounted for rotation on parallel spaced-apart shafts 16'–18', respectively. Drums 15–18 are virtually identical and have outer surfaces made from a relatively hard material, such as plastic, metal, or wood, such outer surfaces being relatively smooth. Each of drums 15–18 has a plurality of cavities 24 extending partially thereinto, from the outer surface thereof, in various depths, sizes, and patterns, as shown. The patterns may be the same or different, as will be described more fully hereinafter. Drum 14 is preferably made from a relatively soft, resilient material, such as rubber.

Figure 2:
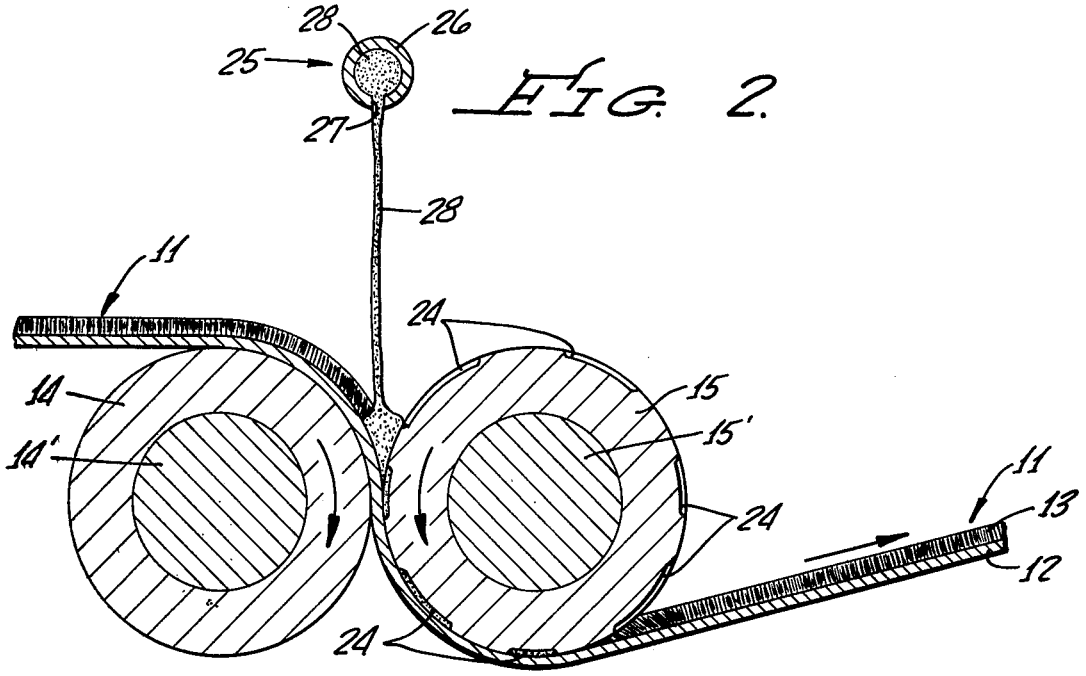
FIGS. 2 and 3 are enlarged sectional views taken along the lines 2—2 and 3—3, respectively, in FIG. 1.

With reference to FIGS. 1 and 2, apparatus 10 includes means, generally designated 25, for conducting a liquid, such as a dye, onto one side of drum 15, above the intersection between drums 14 and 15. According to one embodiment of the invention, means 25 includes an elongate pipe 26 having a plurality of holes 27 in the bottom thereof and means (not shown) for pumping a liquid 28 into pipe 26. As seen in FIG. 2, liquid 28 falls from holes 27 onto carpet pile 13 as carpet 11 extends between drums 14 and 15.

Figure 3:
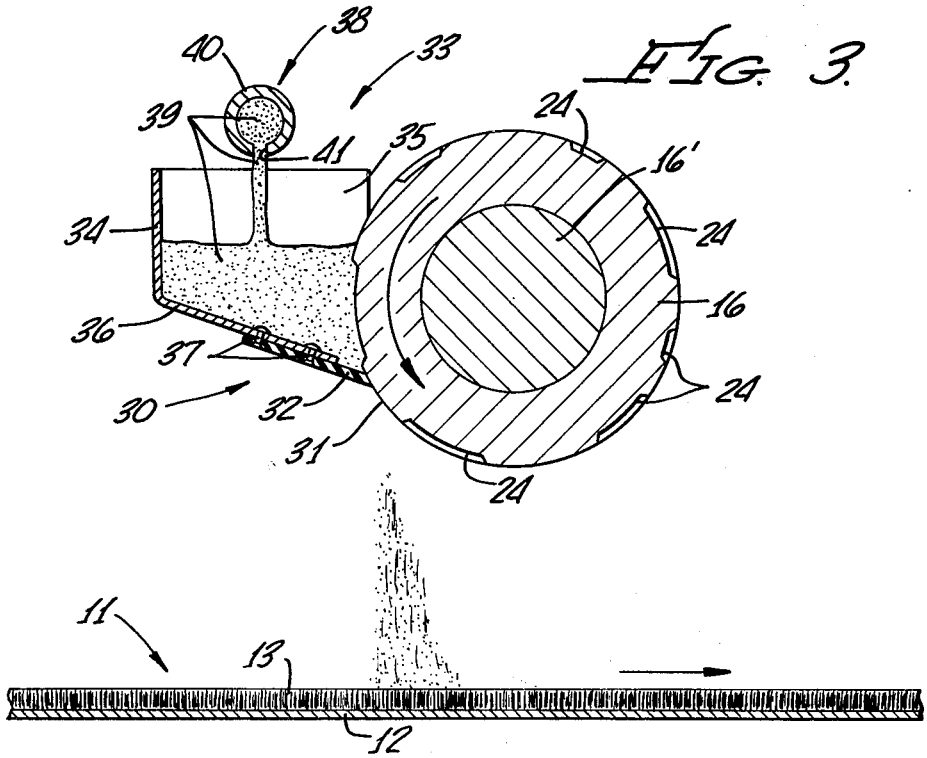

With reference to FIGS. 1 and 3, apparatus 10 includes wiper means, generally designated 30, engaging the outer surface 31 of drum 16, longitudinally along one side thereof. According to the preferred embodiment of the invention, wiper means 30 includes an elongate, planar wiper blade 32 made from a resilient material, such as rubber, one side edge of blade 22 engaging outer surface 31 of drum 21.

Apparatus 10 further includes means, generally designated 33, forming a trough along said one side of drum 16. According to the preferred embodiment of the invention, means 33 includes a side plate 34 positioned in parallel, spaced relationship relative to drum 16, a pair of end plates 35 secured to side plate 34 and engaging surface 31 of drum 16, at opposite ends thereof, and a bottom plate 36, one side edge of which is connected to side plate 34 and the ends of which are connected to end plates 35. The other side edge of plate 36 is spaced from drum 16. Trough forming means 33 also includes wiper blade 32 which is secured to bottom plate 36 by means such as rivets 37.

Apparatus 10 further includes means, generally designated 38, for conducting a liquid 39, such as a dye, into trough forming means 33. According to the preferred embodiment of the invention, liquid conducting means 38 includes an elongate pipe 40 having a plurality of holes 41 in the bottom thereof and means (not shown) for pumping liquid 39 into pipe 40. As seen in FIG. 3, liquid 39 falls from holes 41 into trough forming means 33.

Apparatus 10 includes trough forming means 42 and 43 and liquid conducting means 44 and 45 associated with drums 17 and 18, respectively, which are identical in all respects to trough forming means 33 and liquid conducting means 38, respectively, associated with drum 16. Accordingly, any discussion of drum 16 and the means associated therewith will be equally applicable to drums 17 and 18 and the means associated therewith.

Finally, apparatus 10 includes drive means, generally designated 46, for rotating drums 15–18 on shafts 15'–18', respectively, in the direction of the arrows shown. While each of such drums may be provided with a separate drive means, it is most economical and therefore preferable to use a single drive means 46 for all of such drums. Specifically, shafts 15'–18' may each support at least one gear 47. A first drive chain 48 connected between a power source (not shown) and one of the gears 47 mounted on shaft 15' may be utilized to drive drum 15. A second chain 49 connected between gears 47 mounted on shafts 15' and 16' may be used to drive drum 16 with drum 15. Finally, a third chain 50 interconnecting gears 47 mounted on shafts 16'–18' may be used to drive drums 17 and 18 with drum 16.

In operation, drums 14 and 15 are optional parts of apparatus 10 and function to apply a solid base color to pile 13 of carpet 11 and, in addition, a darker shade of the same color in a random pattern. This enhances the overall appearance of carpet 11 when it exits from apparatus 10. More specifically, carpet 11 enters apparatus 10 over the top side of drum 14, pile side up, and then is squeezed between drums 14 and 15. Pipe 26 conducts dye 28 onto pile 13 of carpet 11, at the intersection between carpet 11 and drum 15. In the absence of cavities 24 in drum 15, drums 14 and 15 would function to squeeze carpet 11 therebetween and limit the amount of dye that can pass with carpet 11 between drums 14 and 15. However, since dye 28 is dispensed directly onto carpet 11, the entire width of carpet 11 is coated so that the end result is a solid base color being applied to the face side of carpet 11.

On the other hand, and in addition, a quantity of dye 28 fills each cavity 24 and this quantity of dye 28 passes between carpet 11 and drum 15, past the intersection between drums 14 and 15, as shown in FIG. 2. This additional quantity of dye 28 soaks into pile 13. Thus, since the face side of carpet 11 which passes below cavities 24 in drum 15 receives a greater quantity of dye 28, the result is a darker shade of the same color being applied to carpet 11 in the random pattern of cavities 24 in drum 15.

As shown in FIGS. 1 and 3, liquid conducting means 38, 44, and 45 conduct dye into trough forming means 33, 42, and 43, respectively. For example, dye 39 which is collected in trough forming means 33 is distributed into the cavities 24 in surface 31 of drum 16 as drum 16 rotates past wiper blade 32. Wiper blade 32 functions to prevent any of dye 39 from passing below the intersection between wiper blade 32 and surface 31 of drum 16, except for the quantity of dye 39 which fills cavities 24. The dye 39 which fills cavities 24 passes below wiper blade 32 and is thrown down onto carpet pile 13, both by gravity and the centrifugal force generated by the rotation of drum 16. A similar effect occurs with regard to drums 17 and 18.

The end result is similar to other types of space dyeing apparatus, but the result is accomplished in a simpler and more economically feasible manner. Specifically, the pattern which is attainable is readily controlled by controlling the depths, sizes, and shapes of the cavities 24 in drums 16–18, by controlling the speeds of rotation of drums 16–18, which speeds may be the same or different, by controlling the speed of carpet 11 through apparatus 10, and by controlling the distance between carpet 11 and drums 16–18.

As mentioned previously, the operation of drums 17 and 18 is the same as that described above with respect to drum 16. Furthermore, three drums are shown for illlustration purposes only, any number of drums being possible. The use of multiple drums allows for different cavity shapes and sizes and different dye colors. The rotary speeds of all drums 15–18 can be controlled independently for even greater versatility in the random pattern application.

Wiper means 30 need not be a wiper blade, but could be soft surface rollers engaging the outer surfaces of drums 16–18. In such case, dye could be conducted to drums 16–18 in the same manner as liquid conducting means 25 conducts dye 28 to drum 15.

Shafts 14'–18' and 21'–23', liquid conducting means 25, 38, 44, and 45, and trough forming means 33, 42, and 43 may be supported in any suitable manner, such as within a single machine housing (not shown). Where required, excess dye flowing over the outer edges of any of drums 15–18 may be collected in a suitable recirculating system (not shown) and pumped back into liquid conducting means 25, 38, 44, and 45 for reuse.

It can therefore be seen that according to the present invention, the problems encountered heretofore are solved by a novel method and apparatus for the continuous, random application of color to carpet or the like. Apparatus 10 and the method embodied therein produces a carpet which is aesthetically pleasing to the eye. The application speed is sufficient to make apparatus 10 economically feasible. In addition, the application of dye can be easily controlled in any number of various patterns. The method of application control is relatively simple as well as being easy to maintain.

While the invention has been described with respect to the preferred physical embodiment constructed in accordance therewith, it will be apparent to those skilled in the art that various modifications and improvements may be made without departing from the scope and spirit of the invention. Accordingly, it is to be understood that the invention is not to be limited by the specific illustrative embodiment, but only by the scope of the appended claims.

We claim:

1. Apparatus for dispensing a liquid dye in a continuous and random pattern onto a moving web of carpet or the like comprising:

an elongate first drum mounted for rotation on its axis and having a plurality of cavities extending partially thereinto from the outer surface thereof, some of said cavities having different depths, sizes, or shapes that others of said cavities;

wiper means engaging said outer surface longitudinally along one side of said first drum;

means for rotating said first drum in a direction such that said one side thereof moves downwardly;

means for conducting said liquid dye to the intersection between said first drum and said wiper means whereby said liquid dye fills said cavities in said first drum, on said one side thereof, as said first drum rotates, said liquid dye in said cavities passing below said wiper means and being dispensed below said first drum; and means for conducting a continuous web of carpet or the like beneath said first drum for receipt of said liquid dye dispensed thereby.

2. Apparatus according to claim 1, wherein said outer surface of said first drum is made from a relatively hard material and is smooth.

3. Apparatus according to claim 2, wherein said wiper means comprises:

a wiper blade made from a resilient material, one side edge of said wiper blade engaging said outer surface of said first drum.

4. Apparatus according to claim 3, further comprising:

means forming a trough along said one side of said first drum, said liquid dye conducting means conducting said liquid into said trough, said wiper blade forming at least a portion of the bottom of said trough.

5. Apparatus according to claim 1, wherein said wiper means comprises:

a wiper blade made from a resilient material, one side edge of said wiper blade engaging said outer surface of said first drum.

6. Apparatus according to claim 5, further comprising:

means forming a trough along said one side of said first drum, said liquid dye conducting means conducting said liquid into said trough, said wiper blade forming at least a portion of the bottom of said trough.

7. Apparatus according to claim 1, further comprising:

a plurality of said first drums mounted in parallel, spaced relation;

a plurality of said wiper means, one for each of said first drums;

means for rotating each of said first drums; and means for conducting a liquid dye to one side of each of said first drums.

8. Apparatus according to claim 7, wherein all of said first drums are rotated by a single drive means.

9. Apparatus according to claim 7, wherein said conducting means conducts said continuous web of carpet or the like beneath all of said first drums for receipt of said liquid dye dispensed thereby.

10. Apparatus according to claim 9, further comprising:

a pair of elongate second drums mounted for rotation on parallel, horizontally spaced-apart axes, said conducting means conducting said continuous web of carpet or the like between said pair of second drums, said pair of second drums squeezing said web therebetween; and means for conducting a liquid dye onto the intersection between the face side of said web of carpet or the like and the one of said pair of second drums which engages said face side, said one of said pair of second drums having a plurality of cavities extending partially thereinto from the outer surface thereof.

11. Apparatus according to claim 10, wherein some of said cavities in said one of said pair of second drums have different depths, sizes or shapes than others of said cavities therein.

12. Apparatus according claim 10, wherein said cavities in said one of said pair of second drums are arranged in a generally irregular pattern.

13. Apparatus according to claim 9, wherein the spacing between each of said first drums and said web of carpet or the like is individually adjustable.

14. Apparatus according to claim 7, wherein each of said first drums has a plurality of cavities extending partially thereinto from the outer surface thereof and wherein the depths, sizes, and shapes of said cavities in said first drums are individually selectable.

15. Apparatus according to claim 14, wherein the depths, sizes, and shapes of the cavities in said first drums are different.

16. Apparatus according to claim 7, wherein the speeds of rotation of said first drums are individually adjustable.

17. Apparatus according to claim 1, further comprising:

a pair of elongate second drums mounted for rotation on parallel, horizontally spaced-apart axes, said conducting means conducting said continuous web of carpet or the like between said pair of second drums, said pair of second drums squeezing said web therebetween; and means for conducting a liquid dye onto the intersection between the face side of said web of carpet or the like and the one of said pair of second drums which engages said face side, said one of said pair of second drums having a plurality of cavities extending partially thereinto from the outer surface thereof.

18. Apparatus according to claim 15, wherein said conducting means conducts said web beneath said first drum after said web exits from between said pair of second drums, said conducting means supporting said web so that said liquid dye dispensed below said first drum and said wiper means falls on said web.

19. Apparatus for dispensing a liquid dye in a continuous and random pattern onto a moving web of carpet or the like comprising:

an elongate drum mounted for rotation on its axis and having a plurality of cavities extending partially thereinto from the outer surface thereof, said cavities being spaced along said outer surface of said drum in a generally irregular pattern;

wiper means engaging said outer surface longitudinally along one side of said drum;

means for rotating said drum in a direction such that said one side thereof moves downwardly;

means for conducting said dye to the intersection between said drum and said wiper means whereby said dye fills said cavities in said drum, on said one side thereof, as said drum rotates, said dye in said cavities passing below said wiper means and being dispensed below said drum in a continuous and random pattern; and means for conducting a continuous web of carpet or the like beneath said drum for receipt of said dye dispensed thereby.

* * * * *